US012630956B2

(12) United States Patent
Hu et al.

(10) Patent No.: US 12,630,956 B2
(45) Date of Patent: May 19, 2026

(54) SOUND MONITORING TO DETECT WATER FILL ISSUES IN A WASHING MACHINE APPLIANCE

(71) Applicant: Haier US Appliance Solutions, Inc., Wilmington, DE (US)

(72) Inventors: Haitian Hu, Louisville, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 277 days.

(21) Appl. No.: 18/464,008

(22) Filed: Sep. 8, 2023

(65) Prior Publication Data

US 2025/0084578 A1 Mar. 13, 2025

(51) Int. Cl.

| | |
|---|---|
| ***D06F 33/47*** | (2020.01) |
| ***D06F 33/34*** | (2020.01) |
| ***D06F 34/04*** | (2020.01) |
| ***D06F 34/14*** | (2020.01) |
| *D06F 105/02* | (2020.01) |
| *D06F 105/58* | (2020.01) |

(52) U.S. Cl.

CPC ..... *D06F 33/47* (2020.02); *D06F 33/34* (2020.02); *D06F 34/04* (2020.02); *D06F 34/14* (2020.02); *D06F 2105/02* (2020.02); *D06F 2105/58* (2020.02)

(58) Field of Classification Search

CPC ..... D06F 33/34; D06F 33/47; D06F 34/04; D06F 34/14; D06F 2103/00; D06F 2103/14; D06F 2105/02; D06F 2105/54; D06F 2105/58; D06F 2105/62

See application file for complete search history.

(56) References Cited

U.S. PATENT DOCUMENTS

| | | | | |
|---|---|---|---|---|
| 9,863,076 | B2 | 1/2018 | Leonard et al. | |
| 10,465,324 | B1 | 11/2019 | Dillon et al. | |
| 11,105,032 | B2 | 8/2021 | Yoon et al. | |
| 2017/0171732 | A1* | 6/2017 | Dao | H04W 4/90 |
| 2020/0041673 | A1* | 2/2020 | Ha | G06N 20/10 |
| 2021/0277564 | A1 | 9/2021 | Mashal et al. | |
| 2022/0307184 | A1 | 9/2022 | Dillon | |
| 2025/0137183 | A1* | 5/2025 | Kang | D06F 33/36 |

FOREIGN PATENT DOCUMENTS

| | | | |
|---|---|---|---|
| CN | 114594691 | A | 6/2022 |

* cited by examiner

*Primary Examiner* — David G Cormier

(74) *Attorney, Agent, or Firm* — Dority & Manning, P.A.

(57) ABSTRACT

A washing machine appliance includes a wash tub positioned within the cabinet and defining a wash chamber, a wash basket rotatably mounted within the wash tub for receiving a load of clothes, a water supply for providing wash fluid into the wash tub, a microphone positioned within the cabinet, and a controller in operative communication with the water supply and the microphone. The controller is configured to monitor a sound signal generated during operation of the washing machine appliance using the microphone, analyze the sound signal to identify a sound signature associated with an adverse operating condition, and implement a responsive action to correct the adverse operating condition in response to identifying the sound signature.

18 Claims, 5 Drawing Sheets

SOUND MONITORING TO DETECT WATER FILL ISSUES IN A WASHING MACHINE APPLIANCE

FIELD OF THE INVENTION

The present subject matter relates generally to washing machine appliances, or more specifically, to methods of identifying water supply issues by monitoring sounds generated during operation of a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Conventional washing machine appliances utilize a water fill algorithm that fills the wash tub by opening the water fill valve for a duration predetermined as a function of the desired fill level. This dispensing duration assumes an average flow rate, however, in real-world scenarios, washers can face the following challenges: 1) they may be installed in areas with low water pressure that result in a lower average flow rate; 2) they may occasionally experience low water pressure due to water usage elsewhere in the household/community; 3) they may encounter clogged valve screens or water lines, etc. Since the water fill algorithm does not compensate for the reduced flow rate associated with such events, opening the valve for a time based on the average flow rate can lead to insufficient water in the wash tub and decreased wash performance. Moreover, low water pressure may cause long-term damage to the washing machine and lead to faster wear and tear of its components.

Accordingly, a washing machine appliance having improved water level detection systems would be desirable. More specifically, a washing machine appliance that incorporates advanced features and control algorithms designed to enhance the water fill process, detect low water pressure, and notify users of the potential risks of clogged water lines would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided including a cabinet, a wash tub positioned within the cabinet and defining a wash chamber, a wash basket rotatably mounted within the wash tub for receiving a load of clothes, a water supply for providing wash fluid into the wash tub, a microphone positioned within the cabinet, and a controller in operative communication with the water supply and the microphone. The controller is configured to monitor a sound signal generated during operation of the washing machine appliance using the microphone, analyze the sound signal to identify a sound signature associated with an adverse operating condition, and implement a responsive action to correct the adverse operating condition in response to identifying the sound signature.

In another exemplary embodiment, a method of operating a washing machine appliance is provided. The washing machine appliance includes a wash tub positioned within a cabinet and defining a wash chamber, a wash basket rotatably mounted within the wash tub, a water supply for providing wash fluid into the wash tub, and a microphone positioned within the cabinet. The method includes monitoring a sound signal generated during operation of the washing machine appliance using the microphone, analyzing the sound signal to identify a sound signature associated with an adverse operating condition, and implementing a responsive action to correct the adverse operating condition in response to identifying the sound signature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
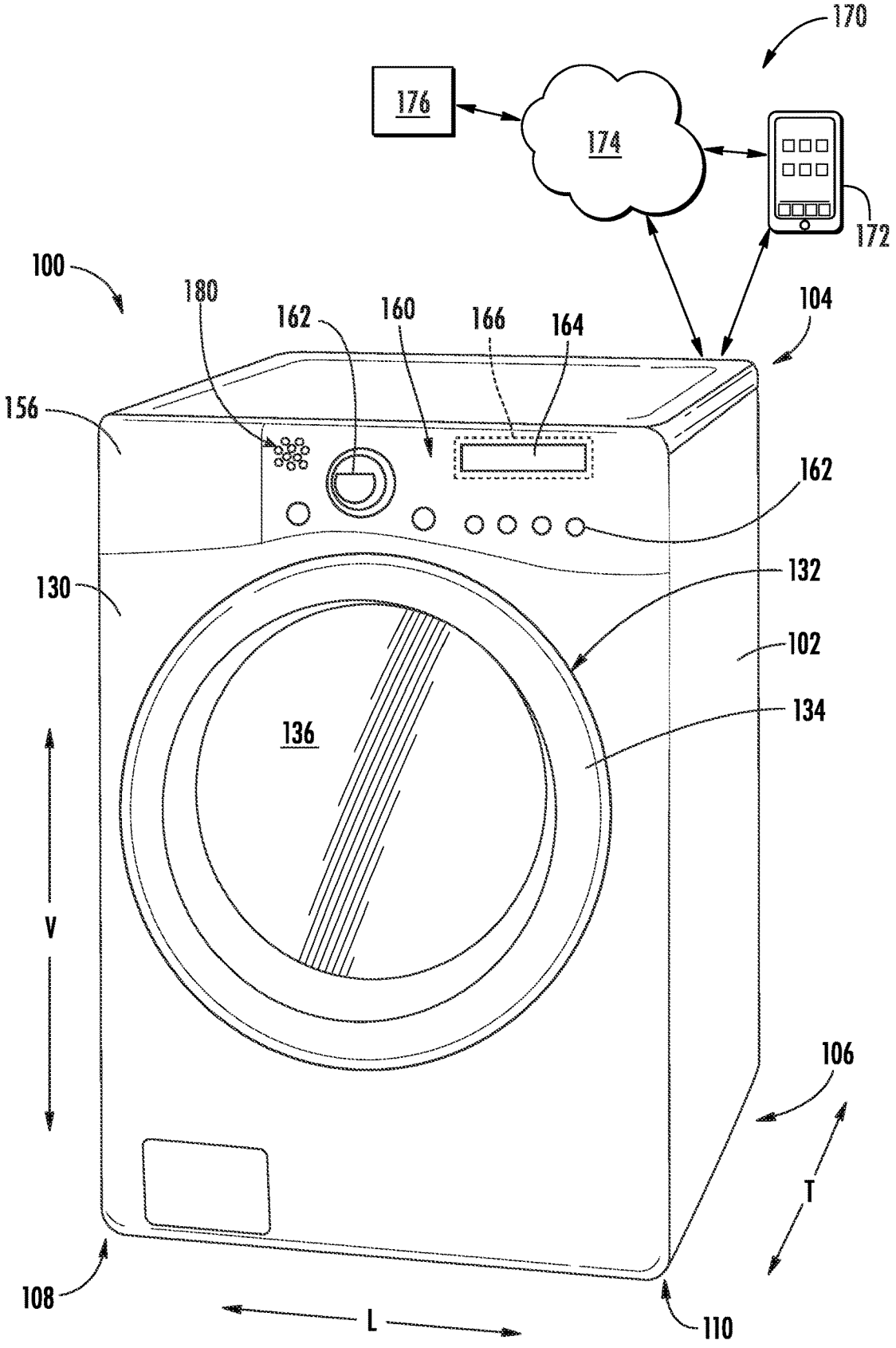
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
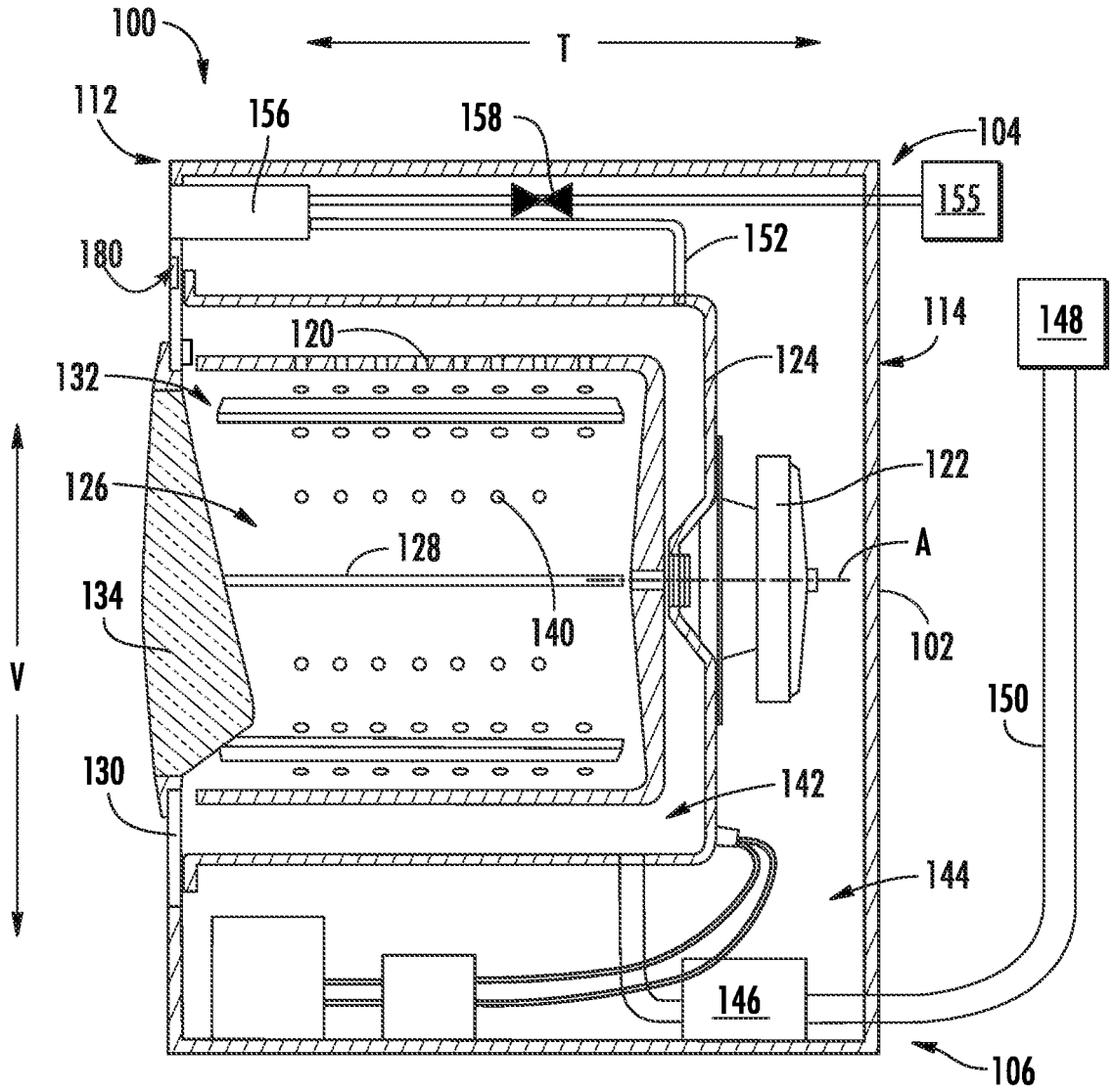
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into wash tub 124. For example, spout 154 may be in fluid communication with a water supply 155 (FIG. 2) in order to direct fluid (e.g., clean water or wash fluid) into wash tub 124. Spout 154 may also be in fluid communication with the sump 142. For example, pump assembly 144 may direct wash fluid disposed in sump 142 to spout 154 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 154 to facilitate the complete and accurate dispensing of wash additive.

In addition, a water supply valve 158 may provide a flow of water from a water supply source (such as a municipal water supply 155) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 154 and or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Referring still to FIG. 1, a schematic diagram of an external communication system 170 will be described according to an exemplary embodiment of the present subject matter. In general, external communication system 170 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 170 may be used to transfer data or other information to improve performance of one or more external devices or appliances and/or improve user interaction with such devices.

For example, external communication system 170 permits controller 166 of washing machine appliance 100 to communicate with a separate device external to washing machine appliance 100, referred to generally herein as an external device 172. As described in more detail below, these communications may be facilitated using a wired or wireless connection, such as via a network 174. In general, external device 172 may be any suitable device separate from washing machine appliance 100 that is configured to provide and/or receive communications, information, data, or commands from a user. In this regard, external device 172 may be, for example, a personal phone, a smartphone, a tablet, a laptop or personal computer, a wearable device, a smart home system, or another mobile or remote device.

In addition, a remote server 176 may be in communication with washing machine appliance 100 and/or external device 172 through network 174. In this regard, for example, remote server 176 may be a cloud-based server 176, and is thus located at a distant location, such as in a separate state, country, etc. According to an exemplary embodiment, external device 172 may communicate with a remote server 176 over network 174, such as the Internet, to transmit/receive data or information, provide user inputs, receive user notifications or instructions, interact with or control washing machine appliance 100, etc. In addition, external device 172 and remote server 176 may communicate with washing machine appliance 100 to communicate similar information.

In general, communication between washing machine appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with washing machine appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP. HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

According to an example embodiment, washing machine appliance 100 may include a microphone 180 that is positioned at any suitable location within the vicinity of washing machine appliance 100 for monitoring sounds generated by washing machine appliance 100. For example, according to the illustrated embodiment, microphone 180 may be positioned within control panel 160 of washing machine appliance 100. In general, microphone 180 may be used for monitoring the sound waves, noises, or other vibrations generated during the operation of washing machine appliance 100. For example, microphone 180 may be one or more microphones, acoustic detection devices, vibration sensors, or any other suitable acoustic transducers that are positioned at one or more locations in or around washing machine appliance 100.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

Figure 3:
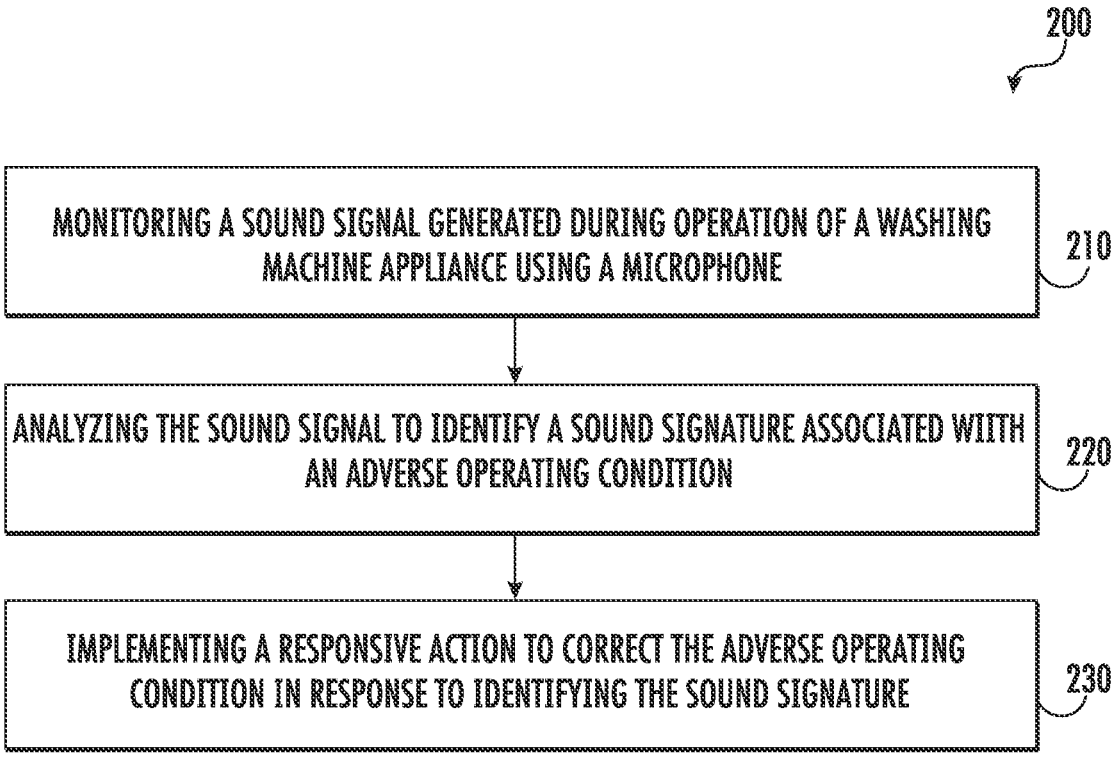
FIG. 3 provides a method for operating a washing machine appliance according to an example embodiment of the present subject matter.
Figure 4:
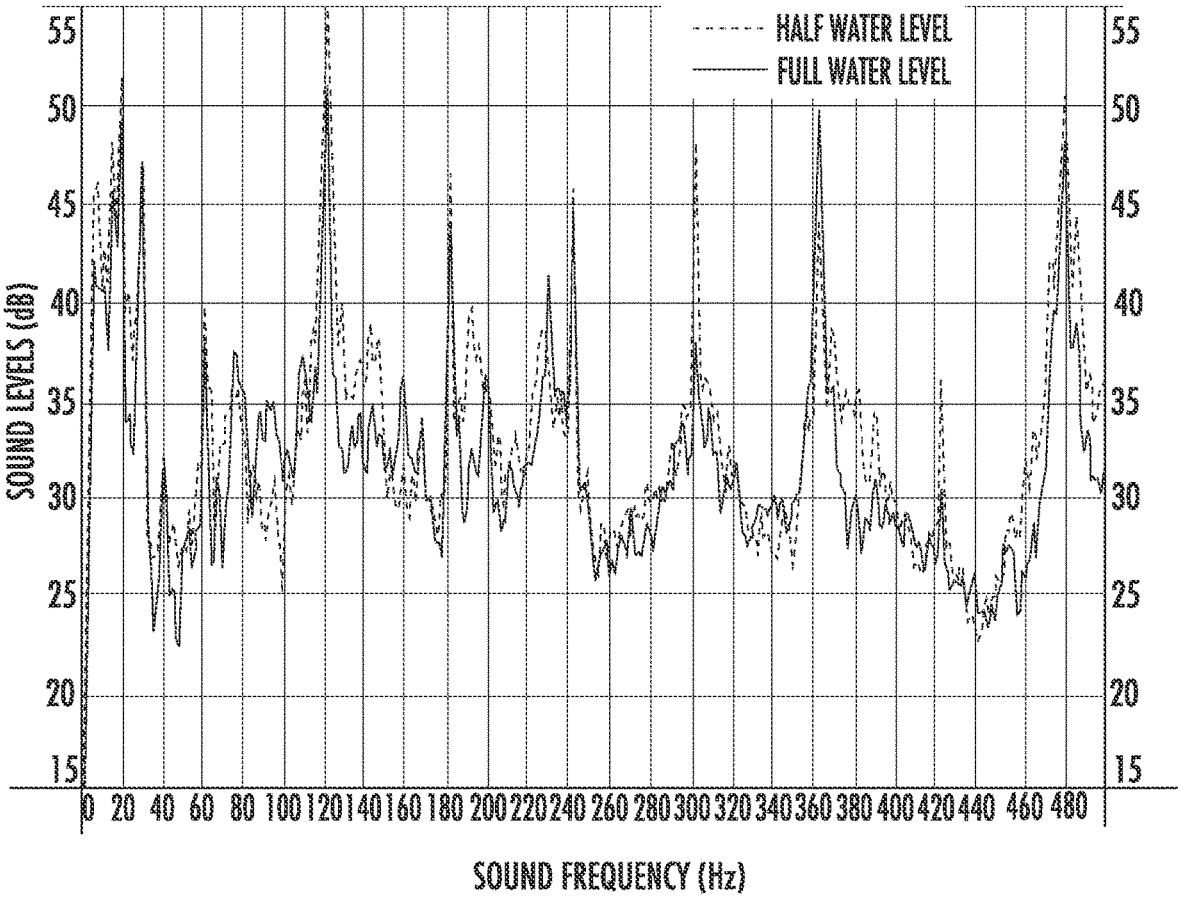
FIG. 4 provides a plot of sound generated during operation of a washing machine appliance with different water fill levels according to an example embodiment of the present subject matter.

Referring now to FIG. 3, method 200 includes, at step 210, monitoring a sound signal generated during operation of a washing machine appliance using a microphone. For example, continuing the example from above, microphone 180 of washing machine appliance 100 may monitor sounds generated during an operating cycle of washing machine appliance 100. For example, referring now briefly to FIG. 4, a plot of sound generated during operation of a washing machine appliance is provided to facilitate discussion of aspects of the present subject matter.

Notably, as explained briefly above, various issues may cause washing machine appliance to be filled with less than a target volume of water prior to an operating cycle. For example, persistent low water pressures, periodic low water pressures, clogged filters, and other problems may cause the water pressure of the water supply 155 to vary. However, varying water supply pressures may affect the auto fill process of washing machine appliance 100. In this regard, for a valve that is open for a predetermined amount of time, lower water pressures would result in less water being supplied than higher water pressures. Moreover, when the amount of water within the wash tub is below the target water level, additional stress may be provided to the drive systems of the washing machine, e.g., such as motor 122, associated transmissions, etc.

Accordingly, aspects of the present subject matter are generally directed to methods for using sound signals generated during operation of a washing machine appliance to detect water levels within the wash tub and associated stresses to the drive system. Moreover, aspects of the present subject matter are directed to methods for mitigating such issues, e.g., by supplying additional water, providing user instructions, or taking other corrective action.

According to an example embodiment, microphone 180 may be used to obtain a sound signal immediately following a fill operation using water supply 155. In this manner, for example, after water is supplied into wash tub 124, motor 122 may begin rotating wash basket 120, thereby generating a sound signal as the wash basket 120 spins up. For example, in FIG. 4, the x-axis represents sound frequency (e.g., in hertz) and the y-axis represents sound amplitude (e.g., in decibels, dB). As explained in more detail below, this sound signal may be analyzed to detect water fill and drive system stress issues associated with the operation of washing machine appliance 100.

Specifically, step 220 may include analyzing the sound signal to identify a sound signature associated with an adverse operating condition. According to example embodiments, this analysis may be performed locally by controller 166 of washing machine appliance 100. According to alternative embodiments, the sound signal may be transmitted to a remote server (e.g., such as remote server 176 via a network 174) for analysis, after which the remote server may return information related to the sound signature and/or the adverse operating condition.

According to an example embodiment, step 220 may include performing cluster analysis on the sound signal to identify the adverse operating condition. In general, the term "cluster analysis" and the like may generally refer to data analysis techniques that identify and explore naturally occurring groups within a data set (e.g., "clusters") and identifying data points that fall outside of the normal trends or clusters. It should be appreciated that any suitable method for performing cluster analysis may be used while remaining within the scope of the present subject matter. For example, cluster analysis may be used to find a running average and standard deviation of cluster data and identifying when data deviates substantially from a predetermined range relative to that cluster data. For example, cluster analysis on the sound signal may be performed to identify trends or deviations and may include identifying a dynamic threshold range for the sound signal and determining that a sound signal falls outside of the dynamic threshold range.

It should be appreciated that controller 166 and/or remote server 176 may maintain the cluster of historic sounds or historical sound data for comparison to the current cycle sound data measured at step 210. In addition, it should be appreciated that sound data from the historical sound data may be periodically removed or added for various reasons, e.g., such as after a change in the appliance operating parameters, an adjustment of the water supply, etc. In addition, it should be appreciated that the currently measured sound signal may be appended to the cluster of historic sounds generated during prior operating cycles, e.g., for future analysis and use.

According to still other embodiments, analyzing the sound signal to identify the sound signature may include comparing a mean, a standard deviation, or a peak difference of the sound signal with a mean, a standard deviation, or a peak difference of historical sound data. For example, referring again to FIG. 4, where the dotted line indicates operation when the water is at half the target level and a solid line indicates operation when the water is at the target level, it can be seen that the half fill results in a larger average sound level (e.g., about 32.9 Hz) than the full fill (e.g., about 31.59 Hz), for a difference of about 4.1%. In addition, it can be seen that the half fill results in a larger standard deviation (e.g., about 5.69) than the full fill (e.g., about 5.19), for a difference of about 9.6%. For example, specifically at 300 Hz and 420 Hz, the sound level is noticeably higher for the half fill relative to the full fill level. It should be appreciated that these numbers are only exemplary and intended to facilitate discussion of aspects of the present subject matter.

The present subject matter is not intended to be limited to such metrics or analytic techniques.

Step 230 may generally include implementing a responsive action to correct the adverse operating condition in response to identifying the sound signature. In this regard, based on the analysis performed in step 220, washing machine appliance 100 may implement corrective action to address or rectify the adverse operating condition identified. Examples of adverse operating conditions and corresponding corrective action are described below to facilitate discussion of aspects of the present subject matter. However, it should be appreciated that these are only examples and that other adverse operating conditions and corrective actions may be made while remaining within the scope of the present subject matter.

According to an example embodiment, the adverse operating condition may be persistently low water pressure. In this regard, for example, if the sound analytics performed at step 220 identify consistently higher sound amplitude generated during appliance operation relative to a known or standard sound profile, this may be indicative of a lower water pressure. It should be appreciated that according to example embodiments, the known or standard sound profile may be provided by a user of the appliance, may be determined using a calibration cycle of the washing machine appliance, may be set by manufacturer based on empirical testing, or may be determined in any other suitable manner. In the event that a persistently low water pressure is detected, step 230 of implementing the responsive action may include permanently adjusting a target water fill level for the washing machine appliance. For example, the target water fill level may be adjusted by manipulating the amount of time that the water supply 155 provides water into the wash tub 124, e.g., to compensate for the lower flow rate.

According to another example embodiment, the adverse operating condition may be a decreased water pressure during a peak water usage time. In this regard, by monitoring the historic sounds signals generated during appliance operation and comparing them to the times of day or the day of the week during which the cycle is performed, method 200 may include determining that the sound levels spike only during certain times of day or days of the week. This may be due to increased water usage from the local municipality or other factors. In order to compensate for this periodic decrease in water pressure, step 230 of implementing the responsive action may include providing a user notification to avoid appliance usage during the peak water usage time. According to still other embodiments, implementing a responsive action may include increasing a target water fill level during the peak water usage time, e.g., by leaving the water supply valve open longer to compensate for the periodically lower water temperatures.

According to another example embodiment, the adverse operating condition is the identification of a consistently decreasing water pressure over time. In this regard, if the sound signal and the historical sound signals indicate a trend of increasing sound amplitudes or sound signatures over a predetermined amount of time, this may be indicative of a clogged filter or screen (e.g., where pressures slowly decrease due to an increased pressure drop as the screen is clogged). Accordingly, step 330 may include providing a user notification to clean a filter of the washing machine appliance when there is a consistent increasing sound signal or an increase in drive system stress.

User notification or communications made during the implementation of method 200 may be communicated to the user in any suitable manner. For example, the user notification may be provided through a user interface panel (such as control panel 160), e.g., such as by providing a message on display 164. According to still other embodiments, the user notification may be communicated directly to the user through external device 172 (e.g., such as the user's cell phone) via network 174. According to still other embodiments, the user notification may be provided to a smart speaker, to another connected appliance, or any other suitable device. In addition, according to example embodiments, method 200 may include communicating with a service technician, scheduling a maintenance service, ordering a new part, etc.

Figure 5:
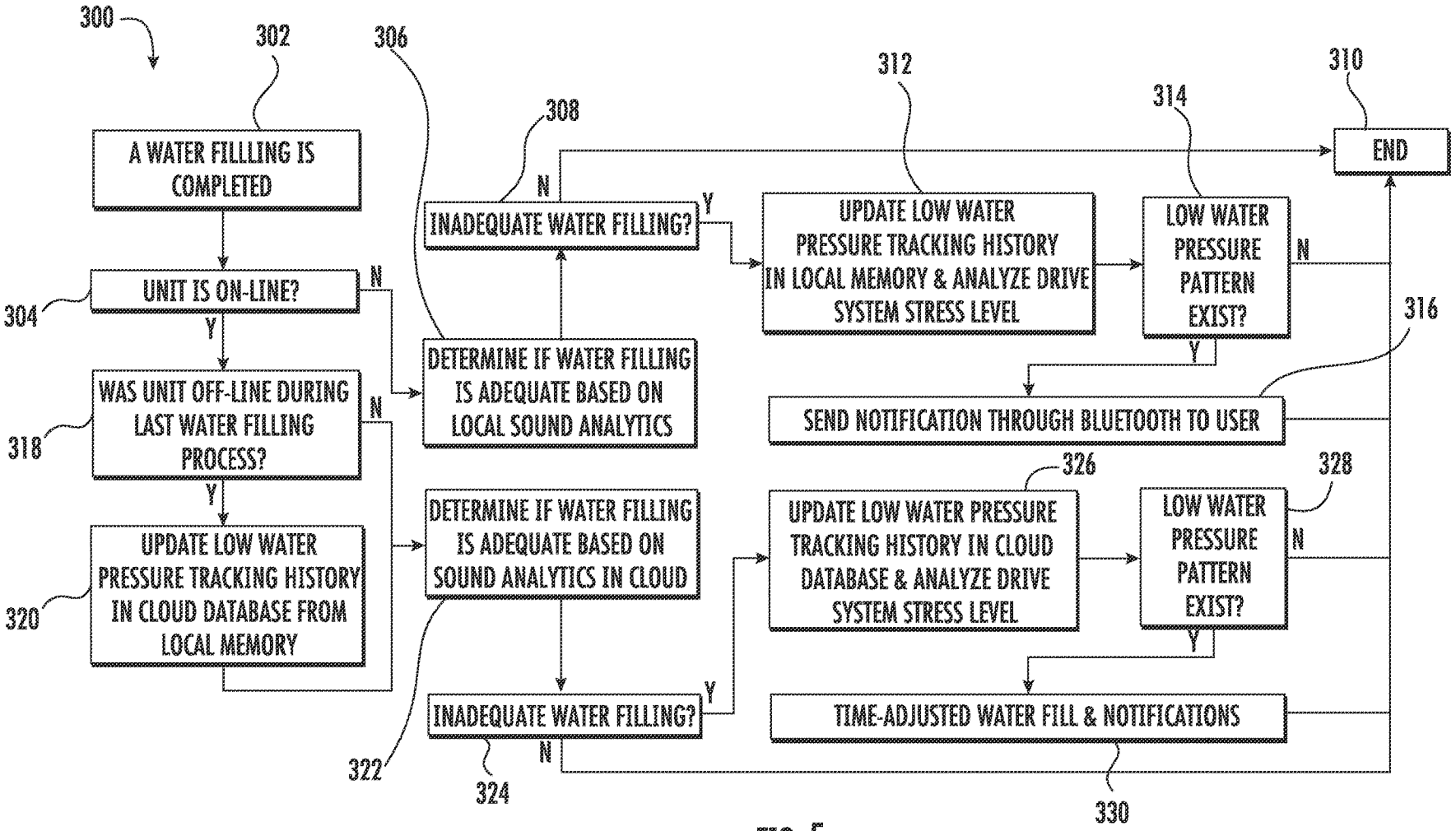
FIG. 5 provides a method for operating a washing machine appliance according to an example embodiment of the present subject matter.

Referring now to FIG. 5, an exemplary method 300 of operating a washing machine appliance will be described. It should be appreciated that the steps of method 200 and method 300 may be the same or similar. In addition, these steps may be interchangeable to form still other methods. As illustrated, step 302 includes determining that the water filling process has been completed. Notably, method 300 may provide for seamless transition between operations where the washing machine appliance is connected or not connected to an external network. Accordingly, step 304 may include determining whether the unit is currently online.

In the event that the unit is not currently connected to the network, step 306 may include determining if the water filling is adequate based on localized sound analytics. In this regard, the washing machine appliance may use a microphone to monitor appliance operation and may analyze the sound signal to determine sound signatures associated with adverse operating conditions. Step 308 includes determining whether the sound signal indicates an adverse operating condition. If there is no adverse operating condition, step 310 may end the process. By contrast, if step 308 results in a determination that there is inadequate water, step 312 may include updating the low water pressure tracking history in local memory and analyzing the drive system stress level. Step 314 includes determining whether a low water pressure pattern exists. If such a pattern exists, step 316 may include notifying the user, e.g., through Bluetooth or other suitable notifications.

Going back to step 304, if the unit is determined to be network connected, step 318 may include determining whether the unit was off-line during the prior water filling process. If the unit was off-line, it may be desirable to update the low water pressure tracking history from the local memory into the cloud database at step 320. Similar to step 306, step 322 includes determining whether water filling is adequate based on sound analytics in the cloud. If step 324 results in a determination that the water filling is inadequate, step 326 may include updating low water pressure tracking history in the cloud database and analyzing the drive system stress level. Similar to step 316, step 328 may include determining whether a low water pressure pattern exists. If such a low pressure pattern exists, step 330 may include performing a time adjustment water fill and/or user notifications, e.g., to clean filters, not operate during peak operation times, etc. Other variations to method 300 are possible and within the scope of the present subject matter.

FIGS. 3 and 5 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of methods 200 and 300 are explained using washing machine appliance 100 as an example, it should be appreciated that this method may be applied to the operation of any washing machine including a microphone.

As explained herein, aspects of the present subject matter are generally directed to systems and methods for identifying extra stress to a drive system of a washing machine that is caused by inadequate water fill. For example, water fill issues may be identified by measuring sound generated during appliance operation using a microphone. The sound may be analyzed using any suitable analysis techniques, e.g., such as through cluster analysis or analyzing factors like mean value, standard deviation, and peak difference. This monitoring may be useful to determine if there is a sufficient amount of wash fluid in the wash tub and for taking corrective action.

By monitoring sound in various scenarios, the strain patterns in a clothes washer's drive system may be deduced and corresponding water filling conditions can be identified. For example, sound that indicates consistent stress levels may indicate low water pressure in the installation area, which can be addressed by adjusting the water fill valve opening time. According to an example embodiment, if the washer experiences extra stress at certain times of the day, it may be due to water usage peaks, and users can be advised to avoid doing laundry during those times. Moreover, rising stress levels could indicate a clogged valve screen, and users can be reminded to perform a cleaning.

Time-adjusted water fill may automatically adjust the valve opening duration based on whether low water pressure or water usage peak condition is observed which is determined by measuring distinct sound spectrum from drive system using a microphone. This may allow users to do laundry conveniently even in areas with unstable water pressures.

Additionally, algorithms may accommodate smooth online/offline status changes of the unit while maintaining sound signature detection and responsive action. For example, when the unit is online, sound analytics of the drive system sound measured by the microphone may be done in cloud database, time of water fill valve may be adjusted, and notifications may be sent via Wi-Fi. By contrast, when the unit is offline, sound analytics may be done in local memory and notifications may be sent via Bluetooth to the user.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub positioned within the cabinet and defining a wash chamber;

a wash basket rotatably mounted within the wash tub for receiving a load of clothes;

a water supply for providing wash fluid into the wash tub;

a microphone positioned within the cabinet; and a controller in operative communication with the water supply and the microphone, the controller being configured to:

monitor a sound signal generated during operation of the washing machine appliance using the microphone;

analyze the sound signal to identify a sound signature associated with an adverse operating condition; and implement a responsive action to correct the adverse operating condition in response to identifying the sound signature, wherein the adverse operating condition is persistent low water pressure, and wherein implementing the responsive action comprises permanently adjusting a target water fill level for the washing machine appliance.

2. The washing machine appliance of claim 1, further comprising:

a user interface panel positioned on the cabinet, wherein the microphone is mounted within the user interface panel.

3. The washing machine appliance of claim 1, wherein the sound signal is monitored after the water supply has added the wash fluid to the wash tub.

4. The washing machine appliance of claim 1, wherein analyzing the sound signal to identify the sound signature comprises:

performing cluster analysis to compare the sound signal with a cluster of historic sounds generated during prior operating cycles of the washing machine appliance.

5. The washing machine appliance of claim 4, wherein the controller is further configured to:

append the sound signal to the cluster of historic sounds generated during the prior operating cycles.

6. The washing machine appliance of claim 1, wherein analyzing the sound signal to identify the sound signature comprises:

comparing a mean, a standard deviation, or a peak difference of the sound signal with a mean, a standard deviation, or a peak difference of historical sound data.

7. The washing machine appliance of claim 1, wherein the controller is in operative communication with a remote server through an external network, and wherein the controller is further configured to:

transmit the sound signal to the remote server through the external network for analysis.

8. The washing machine appliance of claim 7, wherein the controller is further configured to:

determine that the washing machine appliance was not connected to the remote server during a prior operating cycle; and transmit a prior sound signal data associated with the prior operating cycle to the remote server.

9. The washing machine appliance of claim 1, wherein the adverse operating condition is the identification of a consistently decreasing water pressure over time, and wherein the implementing the responsive action comprises:

providing a user notification to clean a filter of the washing machine appliance.

10. The washing machine appliance of claim 1, wherein implementing the responsive action comprises:

providing a user notification regarding the adverse operating condition to a remote device using an external network.

11. A washing machine appliance comprising:

a cabinet;

a wash tub positioned within the cabinet and defining a wash chamber;

a wash basket rotatably mounted within the wash tub for receiving a load of clothes;

a water supply for providing wash fluid into the wash tub;

a microphone positioned within the cabinet; and a controller in operative communication with the water supply and the microphone, the controller being configured to:

monitor a sound signal generated during operation of the washing machine appliance using the microphone;

analyze the sound signal to identify a sound signature associated with an adverse operating condition; and implement a responsive action to correct the adverse operating condition in response to identifying the sound signature, wherein the adverse operating condition is decreased water pressure during a peak water usage time, and wherein the implementing the responsive action comprises:

determining that an operating cycle is selected during the peak water usage time; and providing a user notification to avoid performing an operating cycle during the peak water usage time or increasing a target water fill level during the peak water usage time.

12. A method of operating a washing machine appliance, the washing machine appliance comprising a wash tub positioned within a cabinet and defining a wash chamber, a wash basket rotatably mounted within the wash tub, a water supply for providing wash fluid into the wash tub, and a microphone positioned within the cabinet, the method comprising:

monitoring a sound signal generated during operation of the washing machine appliance using the microphone;

analyzing the sound signal to identify a sound signature associated with an adverse operating condition; and implementing a responsive action to correct the adverse operating condition in response to identifying the sound signature, wherein the adverse operating condition is persistent low water pressure, and wherein implementing the responsive action comprises permanently adjusting a target water fill level for the washing machine appliance.

13. The method of claim 12, wherein the sound signal is monitored after the water supply has added the wash fluid to the wash tub.

14. The method of claim 12, wherein analyzing the sound signal to identify the sound signature comprises:

performing cluster analysis to compare the sound signal with a cluster of historic sounds generated during prior operating cycles of the washing machine appliance.

15. The method of claim 12, wherein analyzing the sound signal to identify the sound signature comprises:

comparing a mean, a standard deviation, or a peak difference of the sound signal with a mean, a standard deviation, or a peak difference of historical sound data.

16. The method of claim 12, further comprising:

determining that the washing machine appliance was not connected to a remote server during a prior operating cycle; and transmitting a prior sound signal data associated with the prior operating cycle to the remote server.

17. The method of claim 12, wherein the adverse operating condition is decreased water pressure during a peak water usage time, and wherein the implementing the responsive action comprises:

determining that an operating cycle is selected during the peak water usage time; and providing a user notification to avoid performing an operating cycle during the peak water usage time or increasing a target water fill level during the peak water usage time.

18. The method of claim 12, wherein the adverse operating condition is a slow decrease in water fill levels over time, and wherein implementing the responsive action comprises:

providing a user notification to clean a filter of the washing machine appliance.

* * * * *